United States Patent [19]

Polak

[11] Patent Number: 5,009,174

[45] Date of Patent: Apr. 23, 1991

[54] ACID GAS BURNER

[75] Inventor: Bob Polak, Toronto, Canada

[73] Assignee: Exxon Research and Engineering Company, Florham Park, N.J.

[21] Appl. No.: 931,136

[22] Filed: Nov. 17, 1986

Related U.S. Application Data

[63] Continuation of Ser. No. 403,258, Dec. 2, 1985, abandoned.

[51] Int. Cl.[5] ..... F23D 1/02

[52] U.S. Cl. ..... 110/264; 431/9; 431/173; 431/207

[58] Field of Search ..... 431/5, 9, 173, 353; 432/222; 110/264

[56] References Cited

U.S. PATENT DOCUMENTS

| | | | |
|---|---|---|---|
| 2,982,348 | 5/1961 | Samothrakis | 431/207 |
| 3,030,773 | 4/1962 | Johnson | 431/9 |
| 3,618,317 | 11/1971 | DeBell | 431/173 |
| 4,154,567 | 5/1979 | Dahmen | 431/5 |
| 4,243,375 | 1/1981 | Reed | 431/174 |
| 4,257,760 | 3/1981 | Schuurman et al. | 431/158 |
| 4,303,386 | 12/1981 | Voorheis et al. | 431/177 |
| 4,351,251 | 9/1982 | Brashers | 431/173 |
| 4,389,188 | 6/1983 | Kamath | 431/284 |
| 4,501,204 | 2/1985 | McCartney et al. | 110/264 |
| 4,507,075 | 3/1985 | Buss et al. | 431/173 |
| 4,515,093 | 5/1985 | Beedmore et al. | 431/173 |
| 4,565,137 | 1/1986 | Wright | 110/264 |

*Primary Examiner*—Henry C. Yuen

*Attorney, Agent, or Firm*—Joseph J. Dvorak

[57] ABSTRACT

The burner of the present invention has a throat section which is in communication with a fire tube located downstream from the throat section. Nozzle means are provided for introducing a fuel in the throat section in a downstream direction toward the fire tube. Very importantly, means are provided for forming a swirling combustion air stream substantially along the side walls of the throat and fire tube thereby reducing the static pressure along the axis of the burner. Also very importantly, means are provided for introducing a gas stream to the throat and downstream of the nozzle means in a swirling direction opposite to that of the swirling combustion air stream.

8 Claims, 1 Drawing Sheet

ACID GAS BURNER

This is a Rule 60 Continuation of U.S. Ser. No. 803,258, filed Dec. 2, 1985, now abandoned, (which was based on Pat. Memorandum SLG-1- 84).

1. FIELD OF THE INVENTION

The present invention relates to burners utilized in combusting a corrosive gas stream, such as acid gas streams. Indeed, the present invention is particularly directed toward acid gas burners utilized in sulfur plant waste heat boilers.

2. DESCRIPTION OF THE PRIOR ART

Burner design today generally employ various devices for bringing about the mixing of the fuel and oxygen so as to assure complete combustion of the fuel. Typically, gas burners have a centrally located fuel nozzle and an air swirler positioned concentrically near the tip of the nozzle and substantially in the center of the burner so as to create a negative pressure along the axis of the burner. The fuel, which may be either a gas or a liquid, is injected in this central region so as to promote combustion through the backmixing of hot gases. One of the benefits achieved by such techniques is that the combustion efficiency is quite high. However, because of the intense combustion that occurs so close to the metal parts of the burner, the metal air swirler and nozzle are subjected to intense heat radiation. If the fuel employed is a very corrosive fuel, such as an acid gas, the metal parts subjected to such intense heat radiation rapidly corrode with concomitant metal loss and fouling which necessitates shutdown and repair of the burner. Additionally, the design of present burners does not permit efficient operation over a wide range of fuel feed pressures. Indeed, experience has shown that burners used to combust corrosive gases, such as the acid gas fed to sulfur plant waste heat boilers, clearly display poor performance and low reliability.

Therefore, there remains a need for a new burner design particularly suitable for combustion of corrosive gases which will provide for enhanced combustion efficiency over a wide range of throughputs with improved operating stability and life.

SUMMARY OF THE INVENTION

The burner of the present invention has a throat section which is in communication with a fire tube located downstream from the throat section. Nozzle means are provided for introducing a fuel in the throat section in a downstream direction toward the fire tube. Very importantly, means are provided for forming a swirling combustion air stream substantially along the side walls of the throat and fire tube thereby reducing the static pressure along the axis of the burner. Also very importantly, means are provided for introducing a gas stream to the throat and downstream of the nozzle means in a swirling direction opposite to that of the swirling combustion air stream.

In a particularly preferred embodiment of the present invention, the means for forming a swirling combustion air stream substantially along the side walls of the burner throat consists of an annular ring having inclined oriented vanes located therein which impart a swirling motion to the combustion air stream along the side walls of the throat. Additionally, since the vanes are located only in an annular ring around a substantially free flow area, the amount of backmixing that would occur along the axis of the burner is reduced. Therefore, the throat of the burner is elongated in an amount sufficient to promote backmixing in an amount substantially equal to that which normally would have occurred if the means for forming a swirling combustion air stream were concentrically positioned with respect to the nozzle and extended to substantially the center of the burner throat.

BRIEF DESCRIPTION OF THE DRAWINGS

These and other features of the invention along with the key benefits derived therefrom and a better understanding of the principles and details thereof will be evident from the following description taken in conjunction with the accompanying drawings in which.

DETAILED DESCRIPTION OF THE INVENTION

Figure 1:
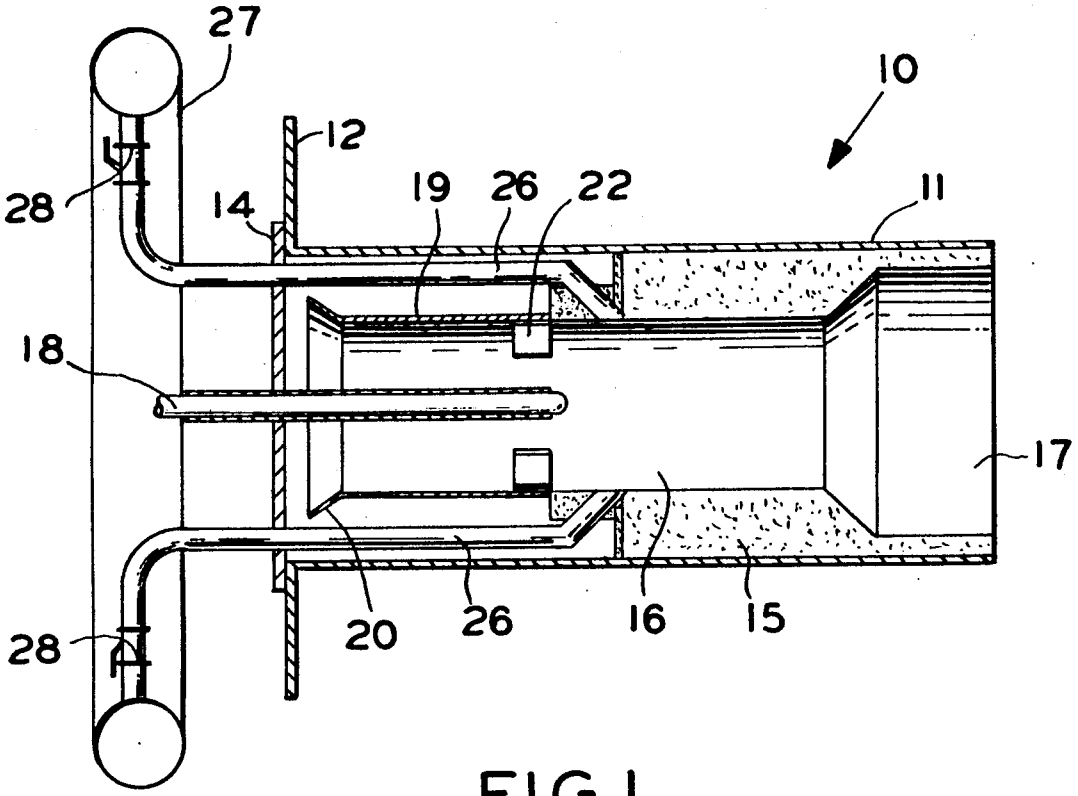
FIG. 1 is a longitudinal sectional view illustrating a preferred embodiment of the invention.

Turning now to the drawings, and in particular to FIG. 1, there is shown one embodiment of the invention in which the burner assembly is indicated generally by the numeral 10. The burner, as shown, has a generally cylindrical steel shell 11 having a flange portion 12 for mounting on the inner face of the wall 14 of a waste heat boiler.

The burner 10 has a refractory lining 15 which defines generally a cylinder throat section 16 which communicates with a cylindrical fire tube 17 downstream from the throat section. As can be seen, the fire tube 17 has a generally larger diameter than the diameter of the throat section 16 of the burner 10.

The nozzle means 18 is centrally located within burner 10. As is shown in nozzle 18 is located so as to be able to introduce supporting fuel into the throat section 16 of the burner 10 in a downstream direction toward the fire tube 17.

Upstream from the throat 16 is a generally cylindrical air duct 19 for supplying the burner with combustion air. As is shown, the duct 19 includes a generally frusto conical section 20 on its upstream end. Importantly, located within the air duct 19 at the interface of the air duct and the throat section is means 22 for imparting a swirling motion to the combustion air stream fed into the burner through air duct 19.

Figure 2:
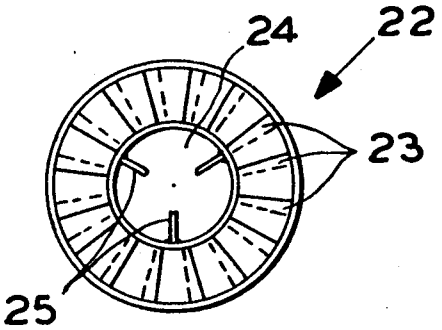
FIG. 2 is an end view of a particularly preferred air swirl means used in accordance with the present invention.

As can be seen in FIG. 2, the air swirler means 22 comprises a plurality of radially extending vanes 23 which are located in an annular ring around a cylindrical substantial open area 24. Additionally, and preferably, the air swirler means 22 provided with the locating means, such as radial arms 25, for proper placement and location of swirler means 22 within the burner 10. Importantly, the vanes 23 of the swirler assembly are slanted or inclined so as to impart the swirling motion through the air stream substantially along the side walls of the throat section 16 of the burner.

Returning to FIG. 1, it can be seen that the burner 10 is also equipped with a plurality of tubular gas feed pipes 26 for supplying the gas to be combusted, for example, acid gas to the throat section 16 in burner 10. Each of these gas feed pipes 26 communicate with a gas manifold 27 generally exterior to the waste heat boiler. While it is not necessary, some or all of the gas feed pipes 26 may be equipped with valves such as valves 28 shown in FIG. 1 for regulating the gas flow through the pipes, if desired. As is shown in FIG. 1, the gas feed pipes 26 open into the throat section of burner 10. Indeed, the gas feed pipes 26 have a forwardly directed bias so that the gas will be fed in the direction of the firing circle, i.e., the area within the throat which is targeted for impact by the supporting fuel and the combustion air.

Figure 3:
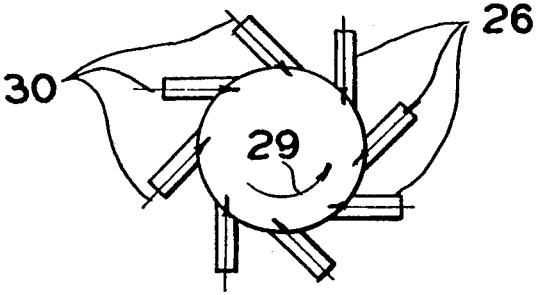
FIG. 3 is a schematic diagram showing the directional flow of a waste gas as well as combustion air in accordance with the present invention.

It is particularly important in the practice of the present invention that the gas feed pipes 26 are oriented so that the combustion gas is introduced tangentially and in a swirling direction opposite to that of the direction of the swirling combustion air stream. This is shown particularly in FIG. 3 where the combustion air stream is shown by arrow 29 as swirling in a substantially counterclockwise direction whereas the combustion gas shown by arrows 30 is introduced in a direction opposite to combustion gas stream 29, i.e., in a clockwise direction.

Since the air swirler 22 of the present invention is so constructed as to promote backmixing in an annular ring along the side wall of the throat section 16, there is little backmixing along the axis of the burner. To compensate for the lack of axial backmixing, the burner 10 has an elongated throat section 16. Basically, the throat section 16 is of a length sufficient to substantially compensate for the lack of axial backmixing in the burner. Additionally, however, the elongated throat section does provide for a stable flame over a wide operating range of the burner 10.

As will be readily appreciated, the burner design of the present invention provides for a number of significant operating benefits. For example, the air swirler and the supporting fuel nozzle are protected from corrosion and fouling since they are removed from the region of intense heat and from the region of introduction of the corrosive combustion gas, i.e., the acid gas. Additionally, the burner of the present invention eliminates back burning and provides a balanced back mixing over a wide range of firing conditions. Also, since the combustion gas is introduced via gas pipes rather than through nozzles which corrode and plug creating high back pressures the need for shutdown and repair of nozzles is clearly eliminated. These, of course, are but a few of the advantages of the burner of the present invention.

While the invention has been described in considerable detail, it is obvious that many changes may be made in the specifics of construction and the arrangement of components without departing from the spirit and scope of the disclosed details. Therefore, the invention should not be limited to the embodiment set forth in the specification for purposes of illustration, but instead should be limited only by the scope of the claims set forth below.

What is claimed is:

1. A burner for combusting a waste gas comprising:

a throat section;

a fire tube downstream from said throat section in communication therewith;

an air duct section upstream from said throat section in communication therewith;

a centrally located nozzle means for introduction of a fuel in said throat section in a downstream direction toward said fire tube;

means upstream from said throat section for forming a downstream directed swirling combustion air stream substantially in an annular ring along the sidewalls of the throat section;

means for introducing a waste gas stream into the throat section downstream of the nozzle means in a forwardly biased but swirling direction opposite to that of said swirling combustion air stream.

2. The burner of claim 1 wherein said means for forming a swirling combustion air stream comprises a plurality of inclined vanes arranged in an annular ring around said nozzle means.

3. The burner of claim 2 wherein said means for introducing a gas stream comprises a plurality of gas feed pipes which are oriented around said throat section in a manner such as to introduce said gas stream in a substantially tangential direction opposite to that of the swirling direction of said combustion air stream.

4. The burner of claim 3 wherein said gas is introduced in the region of the firing circle of said burner.

5. The burner of claim 4 wherein the throat section is sufficiently long so as to promote substantial backmixing of the combustion air and said gas stream fed into said burner.

6. The burner of claim 3 wherein the gas stream feed pipes communicate with a manifold positioned so as to be located exterior a waste heat boiler under conditions of use of said burner.

7. The burner of claim 6 wherein said gas stream feed pipes are equipped with valves for regulating the flow of gas through said pipes.

8. A burner for a waste heat boiler comprising:

a throat section;

a fire tube downstream from said throat section and in communication therewith;

an air duct section upstream from said throat section and in communication therewith;

a centrally located nozzle means for introduction of a fuel in said throat section in a downstream direction toward said fire tube;

a plurality of inclined vanes upstream from said throat section and arranged in an annular ring around said nozzle means for forming a downstream directed swirling combustion air stream substantially in an annular ring along the sidewalls of the throat section;

a plurality of gas feed pipes oriented around said throat section such as to introduce a gas stream in a predetermined region in said throat section in a forwardly biased direction but in substantially tangential direction opposite to that of the swirling direction of said combustion air stream; and wherein said throat section is sufficiently long so as to promote substantial backmixing of said combustion air and said gas stream.

* * * * *